US007741000B2

(12) United States Patent
Nagase et al.

(10) Patent No.: US 7,741,000 B2
(45) Date of Patent: Jun. 22, 2010

(54) IMAGE FORMING METHOD

(75) Inventors: Tatsuya Nagase, Tachikawa (JP); Meizo Shirose, Hachioji (JP); Naohiro Hirose, Hachioji (JP); Asao Matsushima, Hino (JP); Yoshiyasu Matsumoto, Hino (JP); Shiro Hirano, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 441 days.

(21) Appl. No.: 10/922,518

(22) Filed: Aug. 19, 2004

(65) Prior Publication Data

US 2005/0089778 A1 Apr. 28, 2005

(30) Foreign Application Priority Data

Aug. 29, 2003 (JP) ..... 2003-306250

(51) Int. Cl.
*G03G 13/01* (2006.01)

(52) U.S. Cl. ..... 430/123.5; 430/111.4

(58) Field of Classification Search ..... 430/111.4, 430/107.1, 45, 47
See application file for complete search history.

(56) References Cited

U.S. PATENT DOCUMENTS

| | | | | |
|---|---|---|---|---|
| 6,987,942 | B2 * | 1/2006 | Yoshikawa et al. | 399/258 |
| 2002/0039699 | A1 * | 4/2002 | Nishimori et al. | 430/137.11 |
| 2002/0048713 | A1 * | 4/2002 | Komoto et al. | 430/124 |
| 2002/0081510 | A1 | 6/2002 | Sugiyama et al. | |
| 2003/0147670 | A1 * | 8/2003 | Asano et al. | 430/45 |
| 2004/0141771 | A1 * | 7/2004 | Oshiba et al. | 399/159 |

FOREIGN PATENT DOCUMENTS

JP 2003-131430 5/2003

OTHER PUBLICATIONS

Notice of Rejection issued by JPO on Dec. 11, 2007, in connection with App. No. 2003-306250, 2 pgs.
Translation of Notice of Rejection issued by JPO on Dec. 11, 2007, 3 pgs.

* cited by examiner

*Primary Examiner*—Mark F Huff
*Assistant Examiner*—Peter L Vajda
(74) *Attorney, Agent, or Firm*—Squire, Sanders & Dempsey L.L.P.

(57) ABSTRACT

Disclosed is a method for forming color image, in which one of the yellow, magenta, cyan and black toners is a high water content toner, and one of the yellow, magenta, cyan and black toners is a toner low water content toner,
water content of the high water content toner is 1.2 to 2.5% by weight based on the high water content toner, and water content of the low water content toner is 0.1 to 1.2% by weight based on the low water content toner.

16 Claims, 2 Drawing Sheets

TONER HAVING NO CORNERS

TONER HAVING CORNERS

TONER HAVING NO CORNERS

TONER HAVING CORNERS

TONER HAVING CORNERS

IMAGE FORMING METHOD

FIELD OF THE INVENTION

The present invention relates to an electrophotographic image forming method for forming a full color toner image employing four color toners of yellow, magenta, cyan and black.

BACKGROUND OF THE INVENTION

Recently, ones utilizing a digital system are noted in the technology of image formation by electrophotography. For example, a dot image formed by small dots on 1200 dpi level, in which dpi is the number of dot per inch, can be finely reproduced by employing a toner having a small diameter of several micrometers order.

It has been made possible to form a beautiful full color toner image by the use of color toners of yellow, magenta, cyan and black, which is no way inferior to a silver salt photographic image. There is a great need for reproducing a high precision digital image with high fidelity. A technique is applied as one of the countermeasures corresponding to the requirement, in which such the need is satisfied by controlling the physical properties of the toner to satisfy.

Among the conventional art, there is an art in which an attention is drawn to controlling water content of toner, for example, a method to form an image by employing toner whose saturated water content at circumstances of 30 C and 80% RH was adjusted to 0.1 to 2.0% by weight. (For example Patent Documents No. 1 and No. 2)

A toner having saturated water content of 0.1 to 2.0% by weight is employed in the above-mentioned art. There is a problem that an image defect of white spots called toner blister is generated by bubbles of vapor generated from toner layer when the image is formed by superposing four colored toners having high water content.

Alternatively when the four color toners all of them having low water content are employed, such other problems are caused that rising characteristics of toner charge is inferior, image density gradually becomes lower when image is formed continuously, toner content arises in excess, and toner stain within the apparatus is apt to caused.

It is preferred to make size of four color image forming unit, in particular, developing units same for the purpose of making the image forming an apparatus compact, or reducing production cost.

There is an image forming mode in which consumption of four color toners is different from each other as well as a full color image forming mode in which about equal amount of yellow, magenta, cyan and black toners are consumed.

For example, papers for business use consume black toner overwhelmingly. A specific color toner is sometimes consumed markedly in comparison to other colors, when a large amount of paper having a company logo or price list called "pop" used in super markets is printed. Consumption amount of color toners sometimes varies among toners since a specific color toner is frequently consumed according to the image forming mode.

The largely consumed color toner is supplied and charging characteristics of newly supplied toner must be arisen quickly to an available level for image forming.

The image forming unit becomes more compact, the quicker the charging characteristics of newly supplied toner must be arisen in an apparatus with four developing units having uniformed size. However it is difficult because the unit is made compact, and particularly, it is more difficult to raise charging characteristics of largely supplied within the developing unit when toner consumption amount varies among each color toners.

When a toner which is not prepared to have sufficient charging characteristics is used for image forming, such toner is not only form an image on a photoreceptor but it scattered to stain the interior of the image forming apparatus. In particular, it is problem to deteriorated environment of the apparatus when small size toner is employed since the small size toner is apt to scatter and leak outside of apparatus.

Patent Document No. 1: Japanese Patent L.O.P. 2001-209202

Patent Document No. 2: Japanese Patent L.O.P. 2001-201879

DESCRIPTION OF THE INVENTION

The object of this invention is to provide an image forming method, without causing blister on the image after fixing and employing a toner which can be charged to sufficient level quickly for image forming when the toner is supplied, whereby toner scattering or toner leakage outside the apparatus is not induced due to insufficient charging.

SUMMARY OF THE INVENTION

The inventor noticed to the color image forming in which a plurality of color toners are overlaid, and found that generation of toner blister is minimized by interaction of each toner complementary when that characteristic each toner is varied, wherein certain interaction is induced among the toners.

The inventor noticed to content of water in each toner and found that the interaction is caused when the each color toner has different water content.

The invention and its embodiment are described.

An image forming method employing toners comprising yellow, magenta, cyan and black toners for electrostatic latent image developing on an image forming material, wherein one of the yellow, magenta, cyan and black toners is a high water content toner, and one of the yellow, magenta, cyan and black toners other than the high water content toner is a low water content toner, wherein water content of the high water content toner is more than 1.2 to 2.8% by weight based on the high water content toner, and water content of the low water content toner is 0.1 to 1.2% by weight based on the low water content toner.

It is preferred that water content of the high water content toner is 1.3 to 2.0% by weight based on the high water content toner, and water content of the low water content toner is 0.3 to 1.0% by weight based on the low water content toner.

It is preferred that the low water content toner is the magenta toner or the cyan toner.

It is preferred that the high water content toner is the black toner or the yellow toner.

It is preferred that the high water content toner is the black toner.

It is preferred that the high water content toner is the yellow toner.

It is preferred that each toner does not contain a magnetic material. It is also preferred that an average of circularity of toner particles of each the yellow, magenta, cyan and black toners is 0.94 to 0.99.

An image forming method is obtained according to this invention in which toner blister is minimized and toner leakage outside the apparatus is reduced.

BRIEF DESCRIPTION OF THE INVENTION

FIGS. 1(*b*) and 1(*c*) illustrate a projection image of a toner particle having a corner.

PREFERABLE EMBODIMENT TO PRACTICE THE INVENTION

Figure 1:
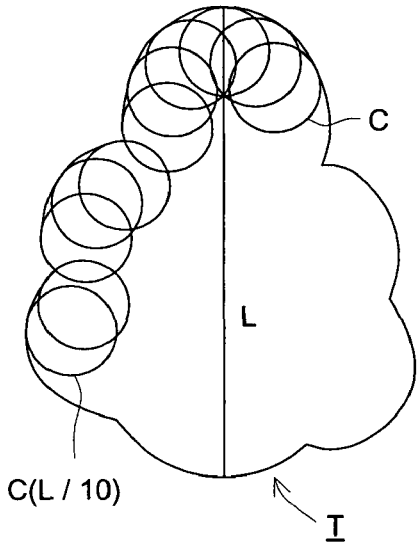
FIG. 1(*a*) shows a drawing to illustrate a projection image of a toner particle having no corner.
Figure 1:
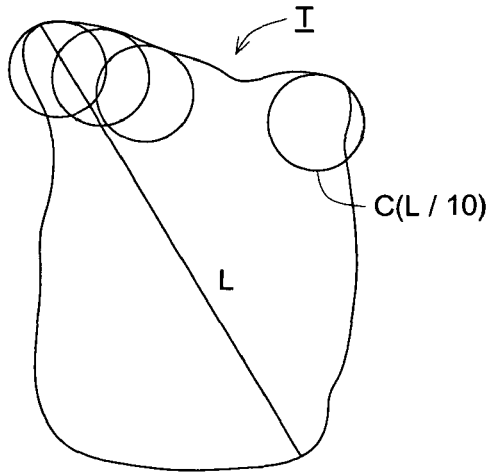
Figure 1:
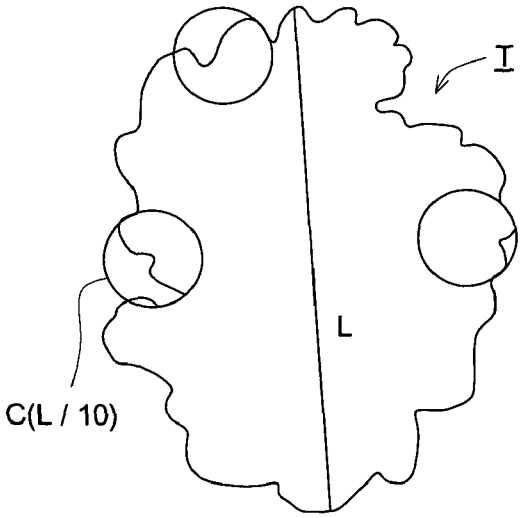

The inventor found that quick charging sufficient to image forming by a small developing device similarly to the full color image forming in which four color toner is consumed similar level even in case of image forming in which specific toner is consumed in majority. An image forming method which satisfies the customers various demand can be provided by this.

Particularly a toner having small particle size, which is employed because of demand of high quality image recently, requires consideration on apparatus so that the scattered toner does not leak outside apparatus. Therefore, it is possible to produce the apparatus in compact and with low cost by employing the small size toner having quick charging characteristics.

Generation of toner blister is effectively prevented by controlling water content of color toner, which is frequently used for forming solid image.

The reason why the toner blister is prevented in the image forming method of this invention is supposed that vapor generated from toner having high water content is adsorbed by a toner having low water content toner during the fixing, and thereby the generation of bubble is prevented and the vapor assists to fixing.

It is also possible to prevent the leakage of scattered toner outside of the apparatus by setting the water content of the toner which is consumed more than the other toner, whereby it becomes possible to charge quickly.

Further, higher charging rate is obtained and no variation of absolute value of charging amount is caused since the toner contains specified amount of water when a charge control agent is added to a toner having high water content, and, therefore, tuning of charging amount is not necessary.

Further, toner blister and leakage of toner outside apparatus are effectively prevented.

Though difference of characteristics between the four color toner has been required to minimized conventionally, high quality image forming method is realized by setting the water content made different in each toner intentionally.

Elements of the present invention are described.

Water Content in the Toner

Water content of the toner used for electro static image development is described.

At least one of the four toners (yellow, magenta, cyan and black) is a low water content toner. The water content of the high water content toner is more than 1.2 to 2.8% by weight based on the high water content toner, and the water content of the low water content toner is 0.1 to 1.2% by weight based on the low water content toner.

Water Content of the High Water Content Toner

The water content of the high water content toner is preferably 1.3 to 2.0% by weight based on the high water content toner. The high water content toner is preferably black toner or yellow toner, and more preferably a black toner.

Water Content of the Low Water Content Toner

The water content of the low water content toner is preferably 0.3 to 1.0% by weight based on the low water content toner. The high water content toner is preferably magenta toner or cyan toner.

Measurement of Water Content of Toner (Measurement of Water Content Per Unit Weight of Toner)

The water content of the toner is a value measured by Karl-Fischer method. A water content measuring apparatus AQS-724, manufactured by Hiranuma Sangyo Co., Ltd., is used to the measurement. The measuring condition is as follows:

Conditioning environment of the sample: The water content in weight-% is measured after standing for 24 hours under a high temperature and humidity condition of 30° C. and 85% HR.

Method to Control Water Content in Toner

A method to control the water content in the toner is not particularly restricted.

Emulsion association method is most suitable to control the water content in the toner among the preparation method of four color toners. Practically the control method includes, (a) controlling amount of coagulant or salting out terminator used for salting in the preparation procedure, and (b) controlling amount of remaining surfactant.

Toner having targeted characteristics can be obtained by that toner particles, which is obtained by processes of salting out, coagulation of composite resin and colored particles, are washed or specific metal element or surfactant in predetermined amount is added during the preparation procedure of the electrostatic image developing toner mentioned later, so as to control the content of coagulant, salting out terminator, or surfactant in the toner to predetermined amount. The term "toner particle" may also be referred to "colored particle" since it is not subjected to process of addition of external additive.

Amount of Metal Element in High Water Content Toner

Amount of metal element in the high water content toner is preferably controlled of 0.50 to 3.0 weight %, more preferably 0.60 to 2.5 weight %, and particularly preferably 0.70 to 1.25% by weight. 0.01 weight % is 100 ppm.

Amount of Metal Element in Low Water Content Toner

Amount of metal element in the low water content toner is preferably controlled of 0.0 to 0.50 weight %, more preferably 0.05 to 0.40 weight %, and particularly preferably 0.08 to 0.30% by weight.

Metal element is usually exists in a form of metal salt in the toner. Example of the metal salt includes a salt of a mono valent metal, such as sodium, potassium, lithium, a salt of a divalent typical metal such as beryllium, magnesium, and a divalent alkali earth metal such as calcium, strontium, barium, radium, a salt of a divalent typical metal such as manganese, copper, and a salt of a trivalent metal such as iron and aluminum.

Practical example of a monovalent metal salt includes sodium chloride, potassium chloride, and lithium chloride. The divalent metal salt includes magnesium chloride, calcium chloride, zinc chloride, copper sulfite, magnesium sulfite, and manganese sulfite. The trivalent metal salt includes aluminum chloride, and iron chloride. These are selectively used for the purpose during the process of toner preparation. Poly aluminum chloride and poly aluminum hydroxide may be used optionally.

Measurement of Metal Element or Metal Ion in the Toner

It is possible to obtain the residual amount of metal elements or metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One, specific measurement method is as follows. A plurality of toners comprising coagulant metal salts, whose content ratios are known, is prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

Toner containing specific water content can be obtained by controlling carboxylic group of toner as one of a method to control water content in the toner.

Measurement of Carboxyl Group in the Toner

The amount of carboxyl group relating to the invention can be measured by dispersing the toner in water and titrating the dispersion. The measurement is performed according to a titration curve of an electric property such as electric conductivity or pH obtained by using a strong alkaline solution such as sodium hydroxide solution. The amount of carboxyl group of the toner is represented by the division of the amount of the carboxyl group obtained by the titration by the weight of the toner, namely the amount of carboxyl group per unit weight of the toner in mole/g.

Measurement of Carboxyl Group in the Toner

An example of the practical measurement is described below.

In a beaker, 1.25 g of the toner is put, and 0.2 g of sodium dodecyl sulfate and 23.55 g of deionized water are added to prepare a dispersion of the sample. The sample dispersion was titrated using 0.01 N sodium hydroxide solution by an electro conductivity titration apparatus, ABU91 AUTOBURETTE and COM 80 CONDUCTIVITY METER, manufactured by Radiometer Co., Ltd.

The amount of sodium hydroxide necessary to neutralize the carboxyl group is lead from the titration curve. When the amount of the sodium hydroxide solution is Y ml, the total amount of carboxyl group in the sample dispersion Mt is calculated as follows:

$$Mt=0.01\times(Y\times10^{-3})\text{moles} \qquad \text{Formula (1)}$$

Accordingly, the amount of carboxyl group per unit weight A of the toner is obtained by the following formula:

$$A=Mt/1.25\ \text{moles/g}$$

For measurement of carboxyl group amount in the toner, the electro conductivity titration method, a potentiometric titration method, an electrophoretic titration and a medium pressure chromatography can be optionally applied as is shown in Gray W. Poelen, Ronald H. Ottewill and James W. Goodwin: Science and Technology of Polymer Colloids, Vol. II, p. 449. Theses method may be applied in combination.

Surface carboxylic group of toner is measured in terms of mole number per unit weight. It is possible to compare by employing value per surface area unit divided by the surface area when the comparison is made to toners having different particle size.

The surface area of the toner used in this instance is preferably a number obtained by converting as an ideal sphere using 50% volume particle diameter Dv50.

Amount of Surface Carboxyl Group of Low Water Content Toner

Amount of surface carboxyl group of low water content toner is preferably not more than $0.5\times10^{-5}$ mol/g, and more preferably $0.1\times10^{-5}$ to $0.4\times10^{-5}$ mol/g.

Amount of Surface Carboxyl Group of High Water Content Toner

Amount of surface carboxyl group of high water content toner is preferably more than $0.5\times10^{-5}$ to $2.8\times10^{-5}$ mol/g, and more preferably $0.7\times10^{-5}$ to $2.3\times10^{-5}$ mol/g. Control method of amount of carboxylic group of toner.

Amount of carboxylic group of toner can be controlled by such a method of varying content of monomer containing carboxylic group in the polymerization monomer, and ratio of amount of monomer and water during polymerization.

Ratio of an amount of the polymerizable monomer to water can be varied optionally. Polymerization reaction does not proceed smoothly when the amount of the polymerizable monomer is more than water, and therefore, it is preferable 40/60 to 3/97, more preferably 35/65 to 5/95.

Polymerizable Monomer Containing Carboxylic Group

Example of the polymerizable monomer containing carboxylic group includes acrylic acid, methacrylic acid, itaconic acid, maleic acid, phthalic acid, crotonic acid, tetrahydroterephthalic acid, α-alkyl substituted acrylic acid whose substituent is preferably an alkyl having 1-4 carbon atoms, and mono alkylmaleic acid whose substituent is preferably an alkyl having 1-4 carbon atoms.

Production Method of the Electrostatic Image Developing Toner

The production method of the electrostatic image developing toner relating to the invention is described below.

The toner to be employed in the invention is preferably one produced by the following procedure: composite resin particles are prepared in the presence of no colorant; a dispersion of colorant particles is added to the dispersion of the composite resin particles; and the composite resin particles and the colorant particles are slated out, coagulated and fused to form the toner particles.

As above-mentioned, the preparation of the composite resin particle is performed without presence of the colorant. Consequently, the polymerization reaction for forming the composite resin particles is not hindered. Therefore, the anti-offset ability of the toner is not degraded and the occurrence of the contamination of the fixing device and the image can be effectively prevented.

Moreover, no monomer or oligomer remains in the obtained toner particles since the polymerization reaction for obtaining the composite resin particle is surely performed. Consequently, occurrence of bad odor in the thermal fixing process of the image forming method can be prevented or reduced.

Furthermore, an image excellent in the sharpness can be formed for a prolonged period since the surface properties of thus obtained toner particles are uniform and the charging property of the particles is sharp.

The composite resin particle is a resin particle having a multi-layered structure, which is composed of a core resin particle, and one or more layers covering the core particle each composed of resins different from the resin of the core particle in the molecular weight and/or the composition.

The "central portion (core)" of the composite particle is the core particle constituting the composite resin particle.

The "outer layer (shell)" of the composite resin particle is the outermost layer among the one or more covering layers.

The "intermediate layer" of the composite resin layer is the layer formed between the central portion (core) and the outer layer (shell).

A multi-step polymerization method is preferably applied for obtaining the composite resin particle from the viewpoint of control of the molecular weight distribution for making sure the fixing strength and the anti-offset ability. The "multi-step polymerization method" for obtaining the composite resin particle is a method in which a monomer is polymerized in the presence of resin particle obtained by polymerization of another monomer to form a polymer on the surface of the resin particle so that the covering layer different from the resin constituting the resin particle in the dispersion state and/or the composition is formed. Plural layers can be formed by repeating the polymerization.

One resin particle layer covering the core resin particle is formed by the two-step polymerization method and more covering layers are formed by three- or more-step polymerization.

Plural kinds of resin different from each other in the composition and/or the molecular weight exist in the composite resin particle obtained by the multi-step polymerization method. Therefore, the scatter of the composition, molecular weight and the surface properties between the individual toner particles is narrow in the toner obtained by salting out, coagulating and fusing the composite resin particle and the colorant particle.

By such the toner comprising toner particles each having the uniform composition, molecular weight and the surface property, the anti-offset and the anti-winding properties can be improved while maintaining the suitable adhesive ability (high fixing strength) to the image support in the image forming methods including the fixing process by the contact heating method.

An example of the production method of the electrostatic image developing toner includes the followings:

(1) A multi-step polymerization process in which composite resin particle is produced by the multi-step polymerization method so as to be contained a releasing agent and/or crystalline polyester in an area (the central portion or the intermediate layer) other than the outermost layer.

(2) A salting out, coagulating and fusing process for obtaining the toner particle by salting out, coagulating and fusing the composite resin particles and the colorant particles.

(3) A filtration and washing process for separating the toner particles from the dispersion system and removing a surfactant from the toner particles by filtering and washing.

(4) A drying process for drying the washed toner particles.

(5) An adding process for adding the external additive to the dried toner particles.

The each of the processes is described below.

Multi-Step Polymerization Process

The multi-step polymerization process is a process for producing the composite particle by two- or more-step polymerization. It is preferable to employ the three- or more-step polymerization from the viewpoint of the stability of the production and the strength to crushing of the resulted toner.

The two-step polymerization method and the three-step polymerization method are described below as the typical examples of the multi-step polymerization method.

Description of the Two-Step Polymerization Method

The two-step polymerization method is a method for producing the composite resin particle constituted by the central portion (core) composed of high molecular weight resin and the outer layer (shell) composed of low molecular weight resin. Namely, the composite resin particle obtained by the two-step polymerization method is constituted by the core and one covering layer.

In concrete, a releasing agent is dissolved in a monomer, and resulted monomer solution is dispersed in an aqueous medium (an aqueous solution of a surfactant) in a state of oil droplets, and then the system is subjected to polymerization treatment (the first step polymerization) to prepare a dispersion of high molecular weight resin particles containing the releasing agent.

After that, a polymerization initiator and a monomer for obtaining the low molecular weight resin are added to the resulted resin particle dispersion and the monomer is polymerized (the second step polymerization) so as to form a covering layer of the low molecular weight resin on the surface of the resin particle.

Description of the Three-Step Polymerization Method

The three-step polymerization method is a method for forming the composite resin layer constituted by a central portion (core) composed of high molecular weight resin, the intermediate layer containing the releasing agent and the outer layer (shell) composed of low molecular weight resin. Namely, the composite resin particle obtained by the three-step polymerization method is constituted by the core and the two covering layers.

In concrete, a dispersion of the resin particles obtained by an ordinary polymerization treatment (the first step polymerization) is added to an aqueous medium (an aqueous solution of a surfactant), and a monomer solution composed of a monomer and a releasing agent dissolved in the monomer is dispersed in the aqueous medium in a state of oil droplets; thus resulted system is subjected to a polymerization treatment (the second step polymerization) to form a covering layer (intermediate layer) composed of resin (polymer of the monomer) containing the releasing agent. Thus a dispersion of composite resin particles (high molecular weight resin/low molecular weight resin) is prepared.

Thereafter, a polymerization initiator and a monomer for forming a low molecular weight resin are added to thus obtained dispersion, and the monomer is subjected to polymerization treatment (the third step polymerization) to form a covering layer composed of the low molecular weight resin (polymer of the monomer) on the surface of the composite resin particle.

On the occasion of the formation of the covering layer on the resin particle in the three-step polymerization method, the releasing agent can be finely and uniformly dispersed by the procedure in which the dispersion of the resin particle is added to the aqueous medium and the monomer solution is dispersed into oil droplets in the medium, and the then system is subjected to the polymerization treatment (the second step polymerization).

The addition of the resin particle dispersion and the oil droplet dispersion of the monomer solution may be performed in any order or simultaneously.

(a) On the occasion of the formation of the intermediate layer constituting the composite resin particle, the resin particle to be form the central portion (core) of the composite particle is added to the solution of the surfactant, after that, the monomer composition containing the releasing agent/crystalline polyester is dispersed in the aqueous solution and then the system is subjected to the polymerization treatment.

(b) On the occasion of the formation of the intermediate layer constituting the composite resin particle, the monomer composition containing the releasing agent/crystalline polyester is dispersed in the aqueous solution of the surfactant, after that, the resin particle to be form the central portion (core) of the composite particle is added to the solution, and then the system is subjected to the polymerization treatment.

(c) On the occasion of the formation of the intermediate layer constituting the composite resin particle, the resin particle to be form the central portion (core) of the composite particle is added to the solution of the surfactant, at the same time, the monomer composition containing the releasing agent/crystalline polyester is dispersed in the aqueous solution, and then the system is subjected to the polymerization treatment.

For forming the resin particle or covering layer each containing the releasing agent, a method can be utilized in which the releasing agent is dissolved in the monomer and the resulted monomer solution is dispersed into the state of oil droplets in the aqueous medium, and then the system was subjected to the polymerization treatment to obtain in a form of latex particle.

The "aqueous medium" is a medium composed of from 50 to 100% by weight of water and from 0 to 50% by weight of a water-soluble organic solvent. Examples of the water-soluble organic solvent are methanol, ethanol, isopropanol, butanol, acetone, methyl ethyl ketone and tetrahydrofuran. Alcohol type solvents are preferable which can not dissolve the obtained resin.

As a suitable method for forming the resin particle or the covering layer each containing the releasing agent, a method is applicable, in which the monomer solution composed of the monomer and the releasing agent dissolved in the monomer is dispersed into the state of oil droplets by applying mechanical energy in the aqueous medium containing the surfactant in a concentration of less than the critical micelle concentration to prepare a dispersion, and then a water-soluble polymerization initiator is added to the resulted dispersion so that the monomer is polymerized in the droplet by radical polymerization (hereinafter referred to as a mini-emulsion method). An oil-soluble polymerization initiator may be added in place of or together with the water-soluble polymerization initiator to the monomer solution.

By the mini-emulsion method, the releasing agent dissolved in the oil phase is not released, different from the usual emulsion polymerization method, and a sufficient amount of the releasing agent can be introduced into the resin particle or the covering layer.

The dispersing machine for dispersing the oil droplets by the mechanical energy is not specifically limited, for example, a stirring apparatus CLEARMIX, manufactured by M•Technique Co., Ltd., having a high speed rotating rotor, a ultrasonic dispersing apparatus, a mechanical homogenizer, Manton-Gaulin homogenizer and a pressing homogenizer are usable. The diameter of the dispersed particle is from 10 nm to 1,000 nm, preferably from 50 nm to 1,000 nm, and more preferable from 30 nm to 300 nm.

Usual methods such as an emulsion polymerization method, a suspension polymerization method and a seed polymerization method are also applicable for forming the resin particle or the covering layer each containing the releasing agent. These polymerization methods may be applied for obtaining the resin particle (core particle) or the covering layer constituting the composite resin particle each containing no releasing agent.

The particle diameter of the composite resin particle obtained by the polymerization process I is preferably from 10 nm to 1,000 nm in terms of weight average diameter measured by an electrophoretic light scattering photometer ELS-800, manufactured by Ootsuka Denshi Co., Ltd.

The glass transition point Tg of the composite resin particle is preferably from 48° C. to 74° C., and more preferably from 52° C. to 64° C. The softening point of the composite resin particle is preferably from 95° C. to 140° C.

Salting Out, Coagulating and Fusing Process II

The salting out, coagulating and fusing process II is a process to form an irregular-shaped (non-spherical) toner particle by salting out, coagulating and fusing the composite resin particles and the colorant particles (causing the salting and fusing simultaneously).

In the salting out, coagulating and fusing process II, internal additive particles (fine particles having a number average particle diameter of from 10 nm to 1,000 nm) such as a charge controlling agent may be salted out, coagulated and fused together with the composite resin particles and the colorant particles.

The colorant particle may be modified on the surface thereof.

The colorant particle is brought into the salting out, coagulating and fusing process in a state of dispersion in an aqueous medium. As the aqueous medium in which the colorant particles are dispersed, an aqueous solution of a surfactant in a concentration more than the critical micelle concentration (CMC) is useful.

A surfactant the same as that employed in the multi-step polymerization I can be used in the above-mentioned.

The dispersing machine for dispersing treatment of the colorant particle is not specifically limited, for example, the stirring apparatus CLEARMIX, manufactured by M•Technique Co., Ltd., having the high speed rotating rotor, a ultrasonic dispersing apparatus, a mechanical homogenizer, Manton-Gaulin homogenizer and a pressing homogenizer, and a medium type dispersing machine such as Getzmann mill and diamond fine mill are usable.

It is preferable for salting out, coagulating and fusing the composite resin particles and the colorant particles to add a coagulation agent in an amount for making a concentration more than the critical coagulation concentration to the dispersion in which the composite resin particles and the colorant particles, and to heat the dispersion by a temperature more than the glass transition point Tg.

It is more preferable to employ a coagulation stopping agent at the time when the diameter of the composite particle is attained at the designate value. A mono-valent metal salt, particularly sodium chloride, is preferably employed as the coagulation stopping agent.

A suitable temperature suitable for the salt out, coagulation and fusion is from (Tg+10° C.) to (Tg+50° C.), and particularly preferably from (Tg+15° C.) to (Tg+40° C.). A water-permissible organic solvent may be added for enhancing the fusion.

As the coagulating agent on the occasion of the salt out, coagulation and fusion, an alkali metal salt and an alkali-earth metal salt are employable.

The salt out and the coagulation in the invention are described below.

The "salt out, coagulation and fusion" is a phenomenon in which the salting out (coagulation of particles) and the fusion (disappear of interface between particles) are simultaneously progressed or an action by which the salting out and the fusion are raised simultaneously.

It is preferable for simultaneously occurring the salt out and the fusion that the particles (the composite resin particle and colorant particle) are coagulated at a temperature not less than the glass transition point Tg of the resin constituting the composite resin particle.

The toner for developing an electrostatic image relating to the invention is preferably produced by the forming composite resin particle in the presence of no colorant, and adding the dispersion of the colorant particles to the dispersion of the composite resin particles, and then salting out, coagulating and fusing the composite resin particles and the colorant particles.

The polymerization reaction is not hindered when the production of the composite resin particle in the system in containing no colorant. Consequently, the excellent ant-offset property is not vitiated and the contamination of the fixing device or the image caused by the accumulation of the toner is not induced.

As a result of that, the polymerization reaction for obtaining the composite resin particle is surely performed, and the monomer or the oligomer is not leaved in the toner particle. Accordingly, any bad odor is not generated in the thermal fixing process of the image forming method of the invention.

Moreover, the image excellent in the sharpness can be formed for a prolonged period since the surface properties of each of the thus obtained toner particles are uniform and the charge distribution is sharp. By the toner in which the toner particles each have the uniform composition, molecular weight and surface property, the anti-offset ability and the anti-winding ability can be improved and the image having suitable glossiness can be obtained while maintaining the good adhesiveness (high fixing strength) in the image forming method including the fixing process by the contact heating system.

A releasing agent is described.

The releasing agent is incorporated in the colored resin particles in an amount of 1-30% by weight, more preferably 2-20% by weight and particularly preferably 3-15% by weight.

Preferable examples of the crystalline material having releasing property include low molecular weight polypropylene having average molecular weight of 1,500 to 9,000 and low molecular weight polyethylene, and a particularly preferable example is an ester compounds represented by Formula described below.

$$R^1—(OCO—R^2)_n$$

wherein n represents an integer of 1 to 4, and preferably 2 to 4, more preferably 3 or 4, and in particular preferably 4.

$R^1$ and $R^2$ each represent a hydrocarbon group which may have a substituent respectively.

$R^1$ has from 1 to 40 carbon atoms, and preferably 1 to 20, more preferably 2 to 5. $R^2$ has from 1 to 40 carbon atoms, and preferably 16 to 30, more preferably 18 to 26. Examples of the compounds are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

-continued

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—HO$
$CH—OH$
$CH_2—O—CO—(CH_2)_{22}—CH_3$

16) $CH_3—(CH_2)_{26}—COO—CH_2—C(CH_3)(CH_2—O—CO—(CH_2)_{26}—CH_3)—CH_2—O—CO—(CH_2)_{26}—CH_3$

-continued

17)

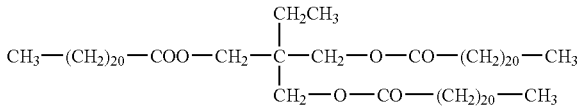

18)

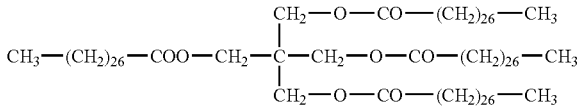

19)

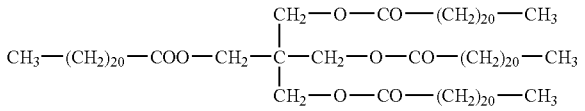

20)

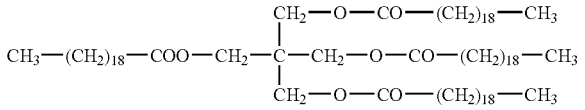

21)

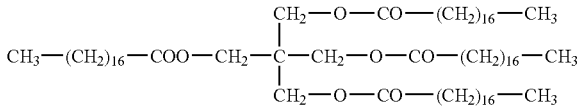

The releasing agent is employed in the toner in an amount of 1-30% by weight, preferably 2-20% by weight, and more preferably 3-15% by weight.

Molecular weight, molecular weight distribution, peak molecular weight etc., of the resin particle composing the toner is described.

A resin used in the toner has a peak or a shoulder of preferably from 100,000 to 1,000,000 and from 1,000 to 50,000.

The resin preferably has a high molecular weight component having a peak or a shoulder in the ranges from 100,000 to 1,000,000, and a low molecular weight component having a peak or a shoulder in the range from 1,000 to 50,000 in the molecular weight distribution.

Molecular weight of the resin composing toner is preferably measured by gel permeation chromatography (GPC) employing tetrahydrofuran (THF).

Added to 1 ml of THF is a measured sample in an amount of 1 mg and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 ml per minute. Then measurement is carried out by injecting approximately 100 μl of said sample at a concentration of 1 mg/ml. It is preferable that commercially available polystyrene gel columns are combined and used. For example, it is possible to cite combinations of SHODEX GPC KF-801, 802, 803, 804, 805, 806, and 807, produced by Showa Denko K.K., combinations of TSKgel G1000H, G2000H, G3000H, G4000H, G5000H, G6000H, G7000H, TSK guard column, and the like.

Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

Filtration and washing process are described.

In the filtration and washing process, filtration is carried out in which said colored resin particles are collected from the colored resin particle dispersion, and washing is also carried out in which additives such as surface active agents, salting-out agents, and the like, are removed from the collected colored resin particles (a cake-like aggregate).

Filtering methods are not particularly limited, and include a centrifugal separation method, a vacuum filtration method which is carried out employing Buchner funnel and the like, a filtration method which is carried out employing a filter press, and the like.

Drying Process

The drying process is one in which said washed colored resin particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the water content of dried toners is preferably not more than 5 percent by weight, and is more preferably not more than 2 percent by weight.

When dried colored resin particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

Polymerizable monomer is described.

(1) Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) a polymerizable monomer containing a carboxylic acid group (—COOH) and (b) a polymerizable monomer containing a sulfonic acid group (—$SO_3H$) can be cited.

Examples of the polymerizable monomer containing the carboxylic acid group (—COOH) of (a) include acrylic acid, methacrylic acid, fumaric acid, maleic acid, itaconic acid, cinnamic acid, maleic acid mono-butyl ester, maleic acid mono-octyl ester and their sodium salts, zinc salts, etc.

Examples of the polymerizable monomer containing the sulfonic acid group (—$SO_3H$) of (b) include sulfonated styrene and its Na salt, allylsulfo succinic acid, allylsulfo succinic acid octyl ester and their sodium salts.

Polymerization initiator is described.

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

The chain transfer agent is described.

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preserve ability, fixing strength, anti-off-set and so on.

The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group.

Among them n-octyl-3-mercaptopropionic acid ester is preferable in view of minimizing smell at the time of thermal fixing.

(Colorants)

The colorant employed in colored resin particles is described.

The colorant is preferably incorporated in the colored resin particles by such a way that the colorant is subjected to salting-out, coagulation and fusion along with the composite resin particles in the colored resin particle preparing process in view of the uniform charge characteristics of the toner.

The toner is obtained by salting out/fusing the composite resinous particles and Toner.

Listed as colorants which constitute the toner may be inorganic pigments, organic pigments, and dyes. Employed as said inorganic pigments may be those conventionally known in the art.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be added to the resinous particles when the toner is used as a magnetic toner. In this instance the magnetite is added in an amount of from 20 to 120 weight % of the toner particle in view of obtaining necessary magnetic characteristics.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 156, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 49, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand PLENACT TTS, 9S, 385, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include PLENACT AL-M.

These surface modifiers is added preferably in amount of 0.01 to 20% by weight, and more preferably 0.1 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Additive into Toner Particles

It is possible to add materials to endow various functions other than a coloring agent and a releasing agent. Concretely, a charge controlling agent is mentioned.

Various kinds of charge controlling agent can be used; for example, a Nigrosine dye, a metal salt of naphthenic acid, or higher fatty acid, alkoxyamine, a quaternary ammonium salt compound, azo metallic complex, a metallic salt of salicylic acid or its metallic complex, etc. can be cited.

(Toner Particles)

Particle diameter of the toner particle is described.

The diameter of the toner is preferably from 3 to 10 μm, and more preferably from 3 to 8 μm in terms of number average diameter. The diameter of the toner can be controlled by the concentration of the coagulation agent, time of the fusion and the composition of the polymer in the later-mentioned production process.

Number of fine toner particles having strong adhesion which fly to heating device and generate off-set is reduced, and high transfer performance is obtained whereby image quality of half tone, fine line, dot and so on is improved by employing the toner having average diameter of 3 to 10 μm.

Number average particle diameter of the toner can be measured by Coulter Counter TA-II, Coulter Multisizer, each manufactured by Coulter-Beckman Co., Ltd., and SD2000 manufactured by Sysmex Co., Ltd.

Herein values are shown which are obtained based on the particle diameter distribution in the range of more than 2.0 μm, for example, 2.0 to 40 μm, employing an aperture having an aperture diameter of 100 μm. The Coulter Multisizer is used together with the interface for outputting particle size distribution (by Nikkaki) and personal computer connected thereto.

(Average of Sphericity of Toner Particles)

Average sphericity of toner particles is preferably 0.94-0.99, more preferably 0.963-0.981, which is an average of sphericity defined below of more than 2,000 toner particles having particle diameter of not more than 1 μm.

(Sphericity)=(circumference length of a circle corresponding to projected particle)/(circumference length of a projected particle)=$2\pi\times((\text{area of a projected particle})/\pi)^{1/2}$/(circumference length of a projected particle)

A circle corresponding to projected particle is a circle having same area of projected particle.

The sphericity is measured by FPIA-2000 manufactured by Sysmex Corporation. The diameter of the circle corresponding to projected particle is defined by formula:

(Diameter of the circle corresponding to projected particle)=$2\times((\text{area of a projected particle})/\pi)^{1/2}$ (Preferable Shape Coefficient of Toner Particles)

Shape coefficient of toner particles is described.

The shape coefficient of the toner particles is expressed by the formula described below and represents the roundness of toner particles.

Shape coefficient=$[(\text{maximum diameter}/2)^2\times\pi]$/projection area wherein the maximum diameter means the maximum width of a toner particle obtained by forming two parallel lines between the projection images of said particle on a plane, while the projection area means the area of the projected image of said toner on a plane.

The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

It is preferable that the ratio of toner particles, having a shape factor in the range of 1.0 to 1.6, is at least 65 percent, more preferably 70 percent, by number with respect to the number of all toner particles. In particular, the ratio of toner particles, having a shape factor in the range of 1.2 to 1.6, is at least 65 percent, more preferably 70 percent, by number with respect to the number of all toner particles.

When the ratio of the toner particle having the shape coefficient of from 1.0 to 1.6, the frictional charging ability by the developer conveying member is made more uniform and accumulation of excessively charged toner is prevented and the problem such as ghost development is difficultly posed since the toner on the developer conveying member is easily exchanged. Moreover, secondary effects such as that the toner particles are difficultly crushed, the contamination of the developer conveying member is inhibited and the charging ability of the toner is stabilized are enhanced.

There is no limitation on the method for controlling the shape coefficient. For example, the toner having the shape coefficient of from 1.0 to 1.6 or that from 1.2 to 1.6 is prepared by a method in which the toner particles are sprayed into hot air stream, a method in which mechanical energy by impact force is repeatedly applying to the toner particles in a gas phase, or a method in which the toner particles are added into a solvent capable of not dissolving the toner particle and the resulted liquid is circled, and thus prepared toner is added to an ordinary toner so as to satisfy the requirements of the invention. Moreover, a method a method in which the shape of the toner particles are entirely controlled in the course of the formation of the toner particle by the polymerization method so that the shape coefficient is made to from 1.0 to 1.6 or from 1.2 to 1.6, and thus prepared toner is added to an ordinary toner as same as in the above.

The variation coefficient of the polymerized toner is calculated using the formula described below:

$$\text{Variation coefficient}=(S1/K)\times 100 \text{ (in percent)}$$

wherein S1 represents the standard deviation of the shape coefficient of 100 toner particles and K represents the average of said shape coefficient.

Said variation coefficient of the shape coefficient is generally not more than 16 percent, and is preferably not more than 14 percent. By employing the toner having variation coefficient of the shape coefficient to not more than 16 percent in combination with a photoreceptor having specific shape at the end portion, resolution and cleaning characteristics are improved, and therefore, good image having good sharpness with reduced uneven half-tone image is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.).

Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

(Number Variation Coefficient of Toner)

The number particle distribution as well as the number variation coefficient of the toner is measured employing a Coulter Counter TA-11 or a Coulter Multisizer (both manufactured by Beckman Coulter Inc.).

In the present invention, employed was the Coulter MULTISIZER which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution, of toner is calculated employing the formula described below:

$$\text{Number variation coefficient}=(S2/D_n)\times 100 \text{ (in percent)}$$

wherein S2 represents the standard deviation in the number particle size distribution and $D_n$ represents the number average particle diameter (in μm).

The number variation coefficient of the toner of the present invention is not more than 27 percent, and is preferably not more than 25 percent.

By employing a toner having the number variation coefficient to not more than 27 percent in combination with a photoreceptor having specific shape at the end portion as above mentioned, resolution and cleaning characteristics are improved, generation of half-tone unevenness is prevented and therefore, good image with good sharpness is obtained.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

(Distribution of Particle Size of Toner Particles)

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in μm) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

The above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

<Measurement Conditions>

Aperture: 100 μm

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured.

To prepare the sample, the resulting mixture is subjected to dispersion treatment for one minute employing an ultrasonic homogenizer.

(Particle Size Distribution of Toner)

Particle size distribution of toner will be described.

Preferable particle size distribution of toner particles is one which is obtained when particles are monodispersed or nearly monodispersed. It is essential that ratio (Dv50/Dp50) is from 1.00 to 1.15, wherein (Dv50) is the 50 percent volume particle diameter and (Dp50) is the 50 percent number particle diameter. The ratio is more preferably from 1.00 to 1.13.

Further, ratio (Dv75/Dp75) is from 1.00 to 1.20, wherein Dv75 is the cumulative 75 percent volume particle diameter from the maximum diameter of the colored particle and Dp75 is the cumulative 75 percent number particle diameter. An increase in weakly charged components, as well as generation of toner having reverse polarity, is minimized, or generation of excessively charged components is minimized.

Further, the proportion of colored particles, having a particle diameter of at most 0.7×(Dp50), is less than or equal to 10 percent by number. In the same manner as described above, an increase in weakly charged components, as well as generation of toner having reverse polarity, are minimized, or generation of excessively charged components is minimized. As a result, it is possible to minimize image degradation due to repellency during transfer as well as during fixing.

Latent image on the photoreceptor is developed by a developer containing a toner having particle size distribution mentioned above, the developed image is transferred to an intermediate transfer material, further it is transferred to a recording material and fixed to obtain the final image. Obtained image using a toner having particle size distribution mentioned above is improved in image defects. The toner having particle size distribution mentioned above improves cleaning ability of a photoreceptor or intermediate transfer material.

The 50 percent volume particle diameter (Dv50) is preferably from 2 to 8 μm, and is more preferably from 3 to 7 μm. By adjusting said diameter to the above range, it is possible to enhance resolution. By adjusting Dv50/Dp50 and Dv75/Dp75 to the specified values as well as by adjusting Dv50 to such a value, it is possible to increase the proportion of toner particles having a minute particle diameter, even though said toner is containing particles having a relatively small diameter, and it is also possible to provide toner capable of forming consistent quality images over an extended period of time.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

It is possible to determine 50 percent volume particle diameter (Dv50), 50 percent number particle diameter (Dp50), cumulative 75 percent volume particle diameter (Dv75), and cumulative 75 percent number particle diameter (Dp75), employing a Coulter Counter Type TAII or a Coulter Multisizer (both are manufactured by Beckman Coulter Inc.).

The proportion of colored particles having a diameter of less than or equal to 0.7×(Dp50) is 10 percent by number. It is possible to determine the amount of said minute particle toner, employing an Electrophoretic Light Scattering Spectrophotometer ELS-800, manufactured by Otsuka Electronics Co., Ltd.

Toner Particles Having No Corners

The shape of toner particles of the present invention is preferably that having no corners, as described below.

Toner particles having no corners are described referring to FIG. 1.

In each of the yellow, magenta, cyan and black toners, the ratio of the number of toner particles having no corners is generally at least 50 percent, and is preferably at least 70 percent.

By adjusting the ratio of the number of toner particles having no corners to at least 50 percent, voids in a transferred toner layer is reduced and off-set phenomena is minimized. In addition it is possible to minimize the formation of a toner having durability against crushing and abrasion and a toner having a part on which charge concentrates, as well as to narrow the charge amount distribution. Thus, since the charge amount distribution is narrowed, it is possible to stabilize chargeability, resulting in excellent image quality over an extended period of time.

The toner particle does not substantially have a corner to which charge or stress is concentrated. The main axis of toner particle T is designated as L, as shown in FIG. 1(*a*). Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 1(*b*) and 1(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

(External Additives)

External additives are described.

Four colored toners are employed to visualize latent images formed on a photoreceptor(s) via dry developing method.

The toner comprises colored particles composed of at least a colorant and a resin, and an external additive added thereto. However the term "toner" is not strictly distinguished from the colored particles usually. Particle diameter or particle diameter distribution is not substantially different between the colored particles and toner particles. This means these values do not substantially different before and after the addition of external additives measured by usual measuring apparatus.

Particle size of the external additives are order of nm in its primary particles, and it can be measured, for example, light scattering electrophoresis particle analyzer ELS-800 manufactured by Otsuka Electronics Co., Ltd.

Inorganic particle can be used as the external additive. Fine particles of silica, titania and alumina are preferably usable. These inorganic particles are preferably hydrophilic ones.

Concrete examples of the silica fine particle include R-805, R-976, R-974, R-972, R-812 and R-809 each manufactured by Nihon Aerosil Co., Ltd., HVK-2150 and H-200, each manufactured by Hoechst Co., Ltd., and TS-720, TS-530, TS-610, H-5 and MS-5, each manufactured by Cabot Co., Ltd. They are all commercial products.

Concrete examples of the titania fine particle include T-805 and T-604 each manufactured by Nihon Aerosil Co., Ltd., MT-100S, MT-100B, MT-500BS, MT-600, MT-600SS and JA-1, each manufactured by Teika Co., Ltd., and TA-300SI, TA-500, TAF-130, TAF-510 and TAF-510T, each manufactured by Fuji Titan Co., Ltd., and IT-S, IT-OA, IT-OB and IT-OC, each manufactured by Idemitsu Kosan Co., Ltd. They are all commercial products.

Concrete examples of the alumina fine particle include RFY-C and C-604, manufactured by Nihon Aerosil Co., Ltd., and TTO-55, manufactured by Ishihara Sangyo Co., Ltd. They are commercial products.

An organic particle having a sphere shape and a number average primary particle diameter of approximately from 10 to 2,000 nm can be used as the external additive. The material of such the particle is, for example, polystyrene, poly(methyl methacrylate) or a styrene-methyl methacrylate copolymer.

Lubricants usable as an external additive include higher fatty acid metal salts. Specific examples thereof include stearic acid metal salts such as zinc stearate, aluminum stearate, copper stearate, magnesium stearate, and calcium stearate; oleic acid metal salts such as zinc oleate, manganese oleate, iron oleate, copper oleate, and magnesium oleate; palmitic acid metal salts such as zinc palmitate, copper palmitate, magnesium palmitate, and calcium palmitate; linolic acid metal salts such as zinc linolate and calcium linolate; ricinolic acid metal salts such as zinc ricinolate and calcium ricinolate.

The amount of an external additive to be added preferably is 0.1 to 5% by weight, based on toner.

Addition step of external additive is described.

The process of adding an external additive is the step of adding the external additive to dried toner particles.

Various know mixing apparatus such as a tabular mixer, a Henschel mixer, a Nauter mixer and a V-type mixer are usable for adding the external additive to the toner.

(Developers)

The developer used in this invention is described.

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, the toner is blended with a carrier and employed as a two-component developer. In this instance, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm The volume average particle diameter of said carrier can be generally determined employing a laser diffraction type particle diameter distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

(Photoreceptor)

Photoreceptor is described.

The photoreceptor has any photosensitive material such as inorganic or organic photosensitive material, and preferably it is applied to an organic photosensitive material. The organic photosensitive material comprises at least one of charge generating function and charge transfer function, which include a photosensitive material composed of organic charge generating material or organic charge transfer material, or a photosensitive material composed of polymer chelate having charge generating function and organic charge transfer function.

The organic photoreceptor is detailed.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm so as to obtain consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωcm or more.

Interlayer

An interlayer may be provided between the electrically conductive support and the photosensitive layer functioning as an electrical barrier adhesion improvement to the photosensitive layer are listed.

The thickness of the interlayer comprised of said hardenable metal resins is preferably between 0.1 and 5

Photosensitive Layer

The photosensitive layer configuration of the photoreceptor of the present invention may be one comprising a single layer structure on said interlayer, which exhibits a charge generating function as well as a charge transfer function. However, a more preferable configuration is that the photosensitive layer is comprised of a charge generating layer (CGL) and a charge transfer layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transfer layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer

The charge generating layer comprises charge generating materials (CGM). As to other materials, if desired, binder resins and other additives may be incorporated.

The charge generating materials employed may be, for example, phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules.

Specifically listed are CGMs of phthalocyanine pigments and perylene pigments having a specific crystalline structure.

For instance, titanyl phthalocyanine having a maximum peak at 27.2° of Bragg angle 2θ with respect to a Cu-Kα line, benzimidazole perylene having a maximum peak at 12.4° of said Bragg 20, and the like, result in minimum degradation after repeated use, and can minimize the increase in residual potential.

Binders may be employed as the dispersion media of CGM. Listed as the most preferable resins are formal resins, butyral resins, silicon resins, silicon modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transfer Layer

The charge transfer layer comprises charge transfer materials (CTM) as well as binders which disperse CTM and form a film. As other materials, if desired, incorporated may be additives such as anti-oxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transfer materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV, from a combined CGM.

The ionization potential of CGM and CTM is measured employing a Surface Analyzer AC-1 (manufactured by Riken Keiki Co., Ltd.).

Cited as resins employed in the charge transfer layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicon resins, melamine resins, and copolymers comprising at least two repeating units of these resins, and other than these insulating resins, high molecular organic semiconductors such as poly-N-vinylcarbazole. The thickness of the charge transfer layer is preferably between 10 and 40 μm.

Thickness of the charge transfer layer is 5-15 μm, preferably 6-13 μm, in view of minimizing dielectric constant on the photoreceptor whereby developability and transferability are stabilized. The thickness of the charge transfer layer can be measured by means of thickness meter employing eddy current such as EDDY 560C, produced by HELMUT FISCHER GMBTE CO. The thickness is an average value randomly measured at 10 points. Difference between maximum and minimum thickness of the charge transfer layer is preferably less than 2 μm.

<Protective Layer>

A resin layer may be provided on a photosensitive layer to protect the photosensitive layer. Particularly cross-linking resin layer gives an organic photoreceptor having mechanical strength.

<Image Forming Method>

An image forming method will be described.

An image forming method using four colored toners of yellow, magenta, cyan and black preferably comprises forming latent images on a photoreceptor having a photosensitive layer provided on an electroconductive support, forming color toner image by developing via developing devices containing each of four color toners, transferring the color toner image onto a transfer material such as paper, and fixing the color toner image on the transfer material such as paper via thermal roll fixing device.

Figure 2:
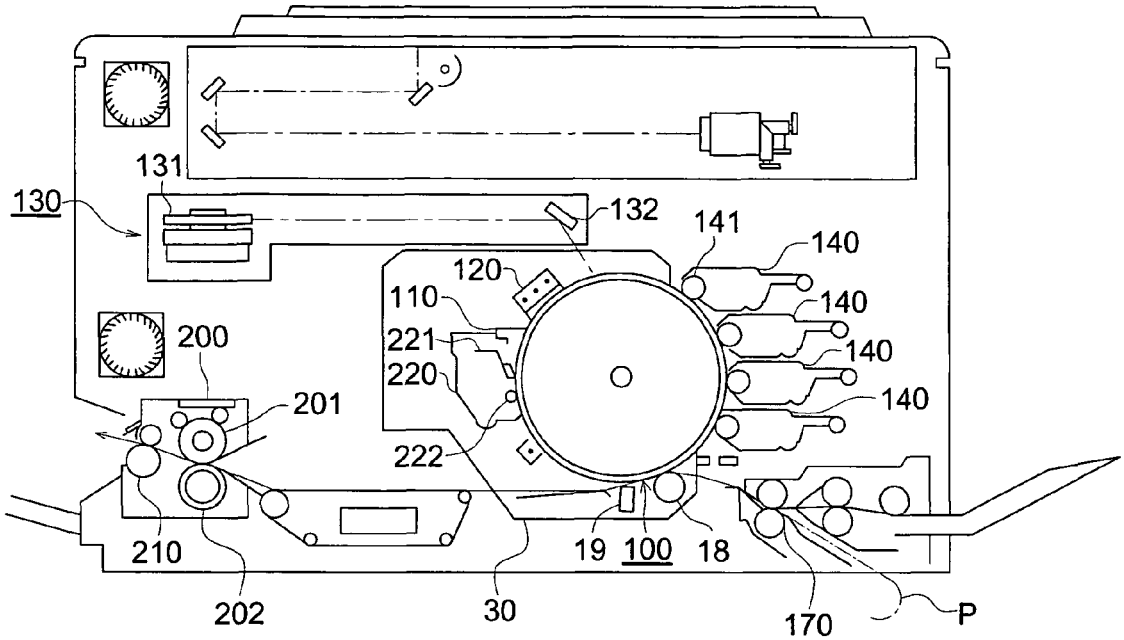
FIG. 2 is a sectional view of an example of an image forming apparatus according to this invention.

FIG. 2 shows a cross section of the structure of an image forming apparatus as an example of the image forming method employing four color toners according to the invention.

In FIG. 2, numeral 100 is a photoreceptor drum as an image carrier which is a photoreceptor comprising a drum and an organic photosensitive layer coated on the drum; the drum is grounded and driven to be clockwise rotated. Numeral 120 is a scorotron charging device as a charging unit which provides uniform charge onto the circumferential surface of the photoreceptor drum 100 by corona discharge. The residual charge on the drum surface may be removed before charging by charging device 120 by using pre-exposing device 110 having a light emission diode for erasing the charge history.

After uniformly charging the photoreceptor, image exposure based on the image information is provided by image exposure device 130 as an image exposing means. The light source of the exposing device 130 is a laser diode which is not shown in the drawing. A latent static image is formed by scanning via light beam along the optical path introduced by reflection mirror 132 through rotating polygon mirror 131 and an fθ lens.

Then the latent static image is developed by a developing device 140 as a developing unit. Developing devices 140 including a developer comprising one of four color toners and a carrier are arranged around photoreceptor drum 100, and the development is performed by first developing sleeve 141 incorporating a magnet and rotated while holding the developer. The developer is conveyed into the developing zone while the layer thickness thereof is regulated at a layer thickness of 100-600 μm by the conveying toner amount regulating member not shown in the drawing, and the development is performed.

At this time, the development is usually performed while applying direct current bias, and alternative current bias based on necessity, between the photoreceptor drum and developing sleeve 141.

In full color image forming method, after completion of the first color development, a second color image formation starts, that is, the photoreceptor is subjected to uniform charging via scorotron charger 120 again, and a second latent image is formed by image exposing device 130. A third and fourth color image are formed similarly, and four color visualized images are formed on the photoreceptor 100.

After the image formation, the image receiving material (paper) P is conveyed to the transfer zone by the rotation of a supplying roller 170 when the timing for the transfer is adjusted. In the transfer zone, the transfer roller (transfer device) is contacted to the surface of circumference surface of the photoreceptor 100 synchronizing with the timing for the transfer so that the plural color images are collectively transferred.

After the separation of the image receiving material (paper) P, the photoreceptor drum 100 is subjected to cleaning by contacting the blade 221 of the cleaning device 220 for removing and cleaning the toner remaining on thereon, and then discharged by the exposing device 110 and charged by the charging device. After that, the photoreceptor drum is introduced into the next image forming process. On the occasion of the formation of the overlaid color images, the blade 221 is moved to depart from the surface of the photoreceptor 100 just after the completion of the cleaning.

On the other hand, after separating image receiving material P, from the photoreceptor drum 100, removal and cleaning of any residual toner remaining is achieved by contact with the cleaning blade 221 of cleaning device 220 and the drum is again neutralized in exposure section 110 and charged by charging device 120, and initiating the subsequent image formation process. The blade 221 moves back immediately after cleaning surface of photoreceptor 100 from circumferential surface thereof in case that color image is formed on the surface of the photoreceptor by superposition.

A process cartridge 30 comprises a photoreceptor, charging unit, separating unit and cleaning unit integrally.

In the electrophotographic image forming apparatus, the constitution elements such as the photoreceptor, developing device and cleaning device may be united into a processing cartridge which can be optionally installed to or released from the main body of the apparatus. Moreover, at least one of the charging device, imagewise exposing device, developing device, transfer device and cleaning device may be united with the photoreceptor to form a processing cartridge capable of optionally installing to or releasing from the main body of the apparatus employing a rail.

In the invention, an image forming apparatus can be employed other than that displayed in FIG. 2, which the toner images formed on the photoreceptor are each successively transferred onto the receiving member (paper of an intermediate transfer member) so as to overlay the images to form the color toner image. An embodiment of such the image forming apparatus is described referring FIG. 3.

Figure 3:
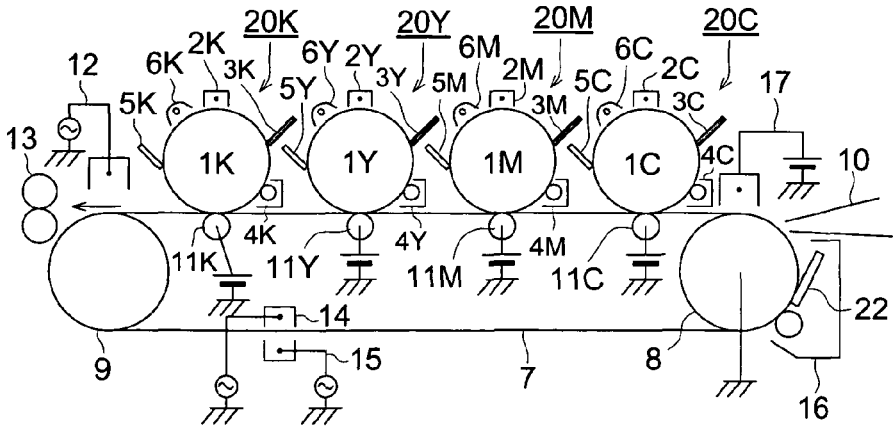
FIG. 3 is a sectional view of an example of an image forming apparatus employing an intermediate transfer body (a transfer belt) according to this invention.

FIG. 3 shows a cross section of an example of the image forming apparatus according to the invention in which an intermediate transfer member is employed. The image forming apparatus shown in FIG. 3 is called as a tandem type full color image forming apparatus.

At the central portion of the interior of the image forming apparatus shown in FIG. 3, a driving roller 9 rotated by a motor, not displayed in the drawing, and a roller 9 rotated following to the driving roller are installed in parallel so that the rotating axes are set each in the horizontal direction, the rollers have almost the same size. The roller 9 is grounded. An endless transfer belt 7 is put without slackening. The transfer belt 7 is a film type belt made from PVDF (vinylidene polyfluoride) or PC (polycarbonate) or a rubber type belt made from chloroprene rubber or urethane rubber. The transfer belt has a width almost the same as that of the driving roller 9, and is driven in the direction of the arrow sign in the drawing (conveying direction of recording material) by the friction at the interior surface of the belt with the rollers.

Along the going way of the transfer belt 7, photoreceptor drums 1C through 1K each carrying a cyan (C), magenta (M), yellow (Y) and black color images are nearly arranged in the order from the side of the following roller 8 so that the rotating axes are parallel with a driving roller 9. These drums are each driven following and synchronizing with the driving of the transfer belt. Around the transfer belt, a cleaning device 16 is provided at the circumference surface of the belt facing the following roller 8, and a paper supplying guide 10 and an attracting charger 17 are provided at the lower course of the stream of the cleaning device along the direction of the arrow sign. A separation charger 12 is provided at the lowest course of the stream after the photoreceptor drums 1C through 1K, and a charge removing charger 14 and 15 are successively provided on the turning way of the transfer belt 7.

In the image forming zones 20C through 20K, the photoreceptor drums 1C through 1K and charging devices 2C through 2K, imagewise exposing devices 3C through 3K, developing devices 4C through 4K, transfer devices 11C through 11K, cleaner 5C through 5K and erasers 6C through 6K are each arranged in this order along the rotating direction of the photoreceptor drum.

The transfer rollers 11C through 11Y and 11K are transfer rollers rotating on the inner surface of the transfer belt.

At the upper portion of the image forming apparatus, not shown in the drawing, an image leading means including a CCD scanner for leading out the original image, an exposing lump, a controlling unit and an image memory, and an optical system including a polygon mirror and a plurality of lens by which the lead image is converted to designated image data and introduced into the image forming means 20C through 20K.

The action of the apparatus is described below. R (red), G (green) and B (blue) components of the image data of the original image are converted to the image data of C, M, Y and K by the data conversion treatment in the controlling unit. The image data are once stored in the image memory by the controlling unit.

Synchronizing with the leading out of the original image, the image receiving material (also called as the image support or recording paper and may be one capable of receiving the image) is conveyed along the paper supplying guide 10 onto the outer surface of the transfer belt 7 just under the absorption charger. The image receiving material is attracted by the positive electrostatic electro force onto the transfer belt 7 when the absorption charger 17 discharges, and conveyed each of the image forming zones 20C through 20K. The image data temporarily stored in the memory are read out synchronously with the conveying of the image receiving material by the transfer belt 7 and modulate the laser light by the controlling unit. The laser light irradiates the surface of the photoreceptor drums through the optical system. And then the developing devices 4C through 4K each form color images on the photoreceptor surface. Thus formed each color component images are successively transferred from the surface of the photoreceptor drums 1C through 1K onto the designated position of the recording paper by electric fields each generated by the transfer rollers 11C through 11K.

After the transfer, the recording paper is discharged and separated from the transfer belt 7 by an alternative electric field generated by separation charger 12, and the image is fixed in the fixing device 13. After that, the recording paper is output from the apparatus.

After separation of the recording paper, the transfer belt 7 is discharged by charge removing chargers 14 and 15 each connected to an alternative current power source and the surface thereof is cleaned by removing the toner adhering on the surface by a cleaning device 16. In the above-mentioned, the description is based on the example of the apparatus employing the photoreceptor drum. Though the photoreceptor is a typical example of the electrostatic latent image carrying member, the image carrying member is not limited to the photoreceptor in the invention. Though the shape of the photoreceptor is not limited to the drum, it may be a belt. Though the transfer belt 7 is described with respect to a soft belt, for example, it may be one having a drum shape.

EXAMPLE

The invention is described below referring examples.

Example 1

Preparation of Low Water Content Toner

Low water content toner was prepared in the following way.

Preparation of Latex (Preparation of Latex 1HML)

(1) Preparation of Latex 1H (Formation of Core Particle: The First Step of Polymerization)

Into a 5,000 ml separable flask, to which a stirring device, a thermal sensor, a cooling pipe and a nitrogen gas introducing device are attached, a surfactant solution (aqueous medium) composed of 3,040 g of deionized water and 4 g of an anionic surfactant represented by the following formula 101 dissolved in the deionized water was charged and heated by 80° C. while stirring at a stirring rate of 230 rpm.

$$C_{10}H_{21}(OCH_2CH_2)_2OSO_3Na \qquad \text{Formula 101}$$

To the surfactant solution, an initiator solution composed of 400 g of deionized water and 10 g of a polymerization initiator (potassium persulfate: KPS) dissolved therein was added and then the temperature was adjusted to 75° C. After that, a mixture of monomers composed of 528 g of styrene, 204 g of n-butyl acrylate, 68 g of methacrylate and 24.4 g of n-octyl-3-mercaptopropionic acid ester was dropped spending 1 hour. The system was heated and stirred at 75° C. for 2 hours to perform the polymerization (the first step polymerization) to form latex. The latex was referred to as Latex 1H.

(2) Preparation of Latex 1HM (Formation of Intermediate Layer: The Second Step of Polymerization)

A monomer solution was prepared by dissolving 77 g of a crystalline compound represented by the foregoing Formula 19, hereinafter referred to as Exemplified Compound 19, into a monomer mixture liquid composed of 95 g of styrene, 36 g of n-butyl acrylate, 9 g of methacrylic acid and 0.59 g of n-octyl-3-mercaptopropionic acid ester at 90° C. in a flask to which a stirring device was attached.

On the other hand, a surfactant solution composed of 1,560 ml of deionized water and, dissolved therein, 1 g of the anionic surfactant represented by Formula 101 was heated by 98° C. and 28 g in terms of solid ingredient of Latex 1H which is a dispersion of the core particles was added to the surfactant solution. Then the above prepared monomer solution of Exemplified Compound 19 was mixed and dispersed for 8 hours in the above resulted liquid by a mechanical dispersing apparatus having a circulation pass CLEARMIX manufactured by M•Technique Co., Ltd., to prepare a dispersion (emulsion) containing emulsified particles (oil droplets) having a particle diameter of 284 nm.

After that, an initiator liquid composed of 200 ml of deionized water and 5 g of the polymerization initiator (KPS) dissolved therein, and the system was heated and stirred for 12 hours at 98° C. to perform polymerization (second step polymerization). Thus latex was obtained which was referred to as Latex 1HM.

(3) Preparation of Latex 1HML (Formation of Outer Layer: The Third Step of Polymerization)

To thus obtained Latex 1HM, an initiator solution composed of 265 ml of deionized water and 6.8 g of the polymerization initiator (KPS) dissolved therein was added and then a monomer mixture liquid composed of 249 g of styrene, 88.2 g of n-butyl acrylate, 2 g of methacrylic acid and 7.45 g of n-octyl-3-mercaptopropionic acid ester was dropped to the latex spending for 1 hour at 80° C. After completion of the dropping, the resulted liquid was heated and stirred for 2 hours for polymerization (third step polymerization), and then cooled by 28° C. to obtain latex. Thus obtained latex was referred to as Latex 1HML.

The weight average particle diameter of the composite resin particles constituting Latex 1HML was 122 nm.

(Preparation of Latex 2L (Shell Material))

Into a flask with a stirring device, an initiator solution composed of 400 ml of deionized water and 14.8 g or the polymerization initiator (KPS) dissolved therein was charged, and a monomer mixture liquid composed of 600 g of styrene, 190 g of n-butyl acrylate, 10.0 g of methacrylic acid and 20.8 g of n-octyl-3-mercaptopropionic acid ester was dropped spending 1 hour at 80° C. After completion of the dropping, the liquid was heated and stirring for 2 hours for progressing the polymerization and then cooled by 27° C. to obtain latex (dispersion of resin particles composed of low molecular weight resin). The latex was referred to as Latex 2L.

The resin particles have a peak molecular weight of 11,000 and a weight average particle diameter of 128 nm.

Preparation Example of Four Low Water Content Toners Having Different Color

Four toners for electrostatic latent image developing were prepared in the following ways.

Preparation of Toner M1: Low Water Content Magenta Toner (1) Preparation of Colorant Dispersion 1

In 1,600 ml of deionized water, 90 g of the anionic surfactant represented by formula (101) was dissolved by stirring. To the solution, 400.0 g of C.I. Pigment Red 122 was gradually added while stirring, and then dispersed by the stirring apparatus CLEARMIX manufactured by M•Technique Co., Ltd. to prepare a dispersion of the colorant particles. The dispersion was referred to as Colorant Dispersion 1.

The particle diameter of the colorant particle in Colorant Dispersion 1 measured by the electrophoretic light scattering photometer ELS-800, manufactured by Otsuka Electronics Co., Ltd., was 110 nm.

(2) (Coagulation Fusion) Preparation of Associated Particle

Into a reaction vessel (four-mouth flask) to which a thermal sensor, a cooling tube, a nitrogen gas introducing device and a stirring device were attached, 420.7 g in terms of solid ingredient of Latex 1HML, 900 g of deionized water and 200 g of Colorant Dispersion 1 were charged. The inner temperature of the vessel was adjusted to 30° C. and then the pH value of the liquid was adjusted to 8 to 11.0 by adding an aqueous solution of sodium hydroxide.

After that, a solution composed of 1,000 ml of deionized water and, dissolved therein, 2 g of magnesium chloride hexahydrate was dropped to the above liquid spending for 10 minutes at 30° C. The liquid was stood for 3 minutes and then heated by 90° C. spending 60 minutes. Under such the conditions, the diameter of the associated particle was measured by Coulter Counter TA-II, and an aqueous solution composed of 1,000 ml of deionized water and, dissolved therein, 12.0 g of sodium chloride was added a time when the number average diameter of the particles was attained at 4-7 μm to stop the growing the particles. Moreover, the fusion of the particles was continued as a ripening treatment by heating and stirring for 6 hours at 98° C.

(3) Shell Forming Process

Furthermore, 96 g of Latex 2L (dispersion of resin particles) was added to the resulted liquid and the system was heated and stirred for 3 hours to fuse latex 2L onto the surface of the associated particle of Latex 1HML. Thereafter, the liquid was added with 40.2 g of sodium chloride and cooled by 30° C. in a rate of 8° C./minute and then the pH was adjusted to 2.0 by the addition of hydrochloric acid, and the stirring was stopped. Thus obtained particles were filtered and repeatedly washed by deionized water at 40° C. and dried by warmed air at 40° C. Thus Colored Particle M1.

The dispersing state of the colorant particles is controlled by means of control of the pH value, the timing of the addition of Latex 2L and the strength of stirring, and further the particle diameter and the variation coefficient of the distribution thereof are controlled by the classification in liquid arbitrary.

Preparation of Toner M2: Low Water Content Magenta Toner

Toner M2 was prepared in the same manner as in Toner M1 except that amount of methacrylic acid was changed to 30 g during the preparation of Latex 2L (shell), and that the amount of magnesium chloride hexahydrate was changed to 5 g during the preparation of associated particle (coagulation fusion process).

Preparation of Toner M3: Low Water Content Magenta Toner

Toner M3 was prepared in the same manner as in Toner M1 except that amount of methacrylic acid was changed to 5 g during the preparation of Latex 1HM (second step polymerization), and that the amount of magnesium chloride hexahydrate was changed to 0.7 g during the preparation of associated particle (coagulation fusion process).

Preparation of Toner C1 through C3: Low Water Content Cyan Toner

Toners C1 through C3 were each prepared in the same manner as Toner M1 through M3 except that 250 g of C.I. Pigment Blue 15:3 was employed in place of 400 g of quinacridone pigment.

Preparation of Toner Y1: Low Water Content Yellow Toner

Toner Y1 was prepared in the same manner as in Toner M1 except that the same manner as Toner M1 except that 400 g of C.I. Pigment Yellow 74 was employed in place of C.I. Pigment Red 122.

Preparation of Toner Bk5: Low Water Content Black Toner

Toner Bk5 was prepared in the same manner as in Toner M1 except that the same manner as Toner M1 except that 400 g of carbon black, Black Pearls L, manufactured by Cabot Co., Ltd., was employed in place of quinacridone pigment.

Preparation of High Water Content Toner

The high water content toners were prepared in the following ways.

Preparation of Latex (Preparation of Latex 2HML)

(1) Preparation of Latex 2H (Formation of Core Particle: The First Step of Polymerization)

Into a 5,000 ml separable flask, to which a stirring device, a thermal sensor, a cooling pipe and a nitrogen gas introducing device are attached, a surfactant solution (aqueous medium) composed of 3,010 g of deionized water and 7.08 g of an anionic surfactant represented by the following formula 101 dissolved in the deionized water was charged and heated by 80° C. while stirring at a stirring rate of 230 rpm.

$C_{10}H_{21}(OCH_2CH_2)_2OSO_3Na$ Formula 101

To the surfactant solution, an initiator solution composed of 200 g of deionized water and 9.2 g of a polymerization initiator (potassium persulfate: KPS) dissolved therein was added and then the temperature was adjusted to 75° C. After that, a mixture of monomers composed of 70.1 g of styrene, 19.9 g of n-butyl acrylate and 10.9 g of methacrylate r was dropped spending 1 hour. The system was heated and stirred at 75° C. for 2 hours to perform the polymerization (the first step polymerization) to form latex. The latex was referred to as Latex 2H.

(2) Preparation of Latex 2HM (Formation of Intermediate Layer: The Second Step of Polymerization)

A monomer solution was prepared by dissolving 98.0 g of a crystalline compound represented by the foregoing Formula 19, hereinafter referred to as Exemplified Compound 19, into a monomer mixture liquid composed of 105.6 g of styrene, 30.0 g of n-butyl acrylate, 6.2 g of methacrylic acid and 5.6 g of n-octyl-3-mercaptopropionic acid ester at 90° C. in a flask to which a stirring device was attached.

On the other hand, a surfactant solution composed of 2,700 ml of deionized water and, dissolved therein, 1.6 g of the anionic surfactant represented by Formula 101 was heated by 98° C. and 28 g in terms of solid ingredient of Latex 1H which is a dispersion of the core particles was added to the surfactant solution. Then the above prepared monomer solution of Exemplified Compound 19 was mixed and dispersed for 8 hours in the above resulted liquid by a mechanical dispersing apparatus having a circulation pass CLEARMIX manufactured by M•Technique Co., Ltd., to prepare a dispersion (emulsion) containing emulsified particles (oil droplets) having a particle diameter of 284 nm.

After that, an initiator liquid composed of 240 ml of deionized water and 5.1 g of the polymerization initiator (KPS) dissolved therein, and the system was heated and stirred for 12 hours at 98° C. to perform polymerization (second step polymerization). Thus latex was obtained which was referred to as Latex 2HM.

(3) Preparation of Latex 2HML (Formation of Outer Layer: The Third Step of Polymerization)

To thus obtained Latex 2HM, an initiator solution composed of 200 ml of deionized water and 7.4 g of the polymerization initiator (KPS) dissolved therein was added and then a monomer mixture liquid composed of 300 g of styrene, 95 g of n-butyl acrylate, 15.3 g of methacrylic acid and 10.4 g of n-octyl-3-mercaptopropionic acid ester was dropped to the latex spending for 1 hour at 80° C. After completion of the dropping, the resulted liquid was heated and stirred for 2 hours for polymerization (third step polymerization), and then cooled by 28° C. to obtain latex, containing core portion of high molecular weight resin, intermediate layer of middle molecular weight resin and outer layer of low molecular weight resin, wherein the intermediate layer contains Exemplified Compound 19. Thus obtained latex was referred to as Latex 1HML.

The composite resin particles have peak molecular weight at 138,000, 80,000, and 13,000 and the weight average particle diameter of the composite resin particles constituting Latex 2HML was 122 nm.

(Preparation of Latex 3L (Shell Material))

Into a flask with a stirring device, an initiator solution composed of 400 ml of deionized water and 14.8 g or the polymerization initiator (KPS) dissolved therein was charged, and a monomer mixture liquid composed of 600 g of styrene, 190 g of n-butyl acrylate, 30.0 g of methacrylic acid and 20.8 g of n-octyl-3-mercaptopropionic acid ester was dropped spending 1 hour at 80° C. After completion of the dropping, the liquid was heated and stirring for 2 hours for progressing the polymerization and then cooled by 27° C. to obtain latex (dispersion of resin particles composed of low molecular weight resin). The latex was referred to as Latex 3L.

The resin particles have a peak molecular weight of 11,000 and a weight average particle diameter of 128 nm. Preparation example of four high water content toners having different color Preparation of Toner Bk1: High Water Content Magenta Toner In 1,600 ml of deionized water, 59.0 g of the anionic surfactant represented by formula (101) was dissolved by stirring. To the solution, 420.0 g of carbon black Regal 330, manufactured by Cabot Co., Ltd., was gradually added while stirring, and then dispersed by the stirring apparatus CLEARMIX manufactured by M•Technique Co., Ltd. to prepare a dispersion of the colorant particles. The dispersion was referred to as Colorant Dispersion 1.

The particle diameter of the colorant particle in Colorant Dispersion 1 measured by the electrophoretic light scattering photometer ELS-800, manufactured by Otsuka Electronics Co., Ltd., was 90 nm.

Into a reaction vessel (four-mouth flask) to which a thermal sensor, a cooling tube, a nitrogen gas introducing device and a stirring device were attached, 420.7 g in terms of solid ingredient of Latex 2HML, 900 g of deionized water and 200 g of Colorant Dispersion 1 were charged. The inner temperature of the vessel was adjusted to 30° C. and then the pH value of the liquid was adjusted to 8-11.0 by adding an aqueous solution of sodium hydroxide.

After that, a solution composed of 1,000 ml of deionized water and, dissolved therein, 12.1 g of magnesium chloride hexahydrate was dropped to the above liquid spending for 10 minutes at 30° C. The liquid was stood for 3 minutes and then heated by 90° C. spending 60 minutes. Under such the conditions, the diameter of the associated particle was measured by Coulter Counter TA-II, and an aqueous solution composed of 1,000 ml of deionized water and, dissolved therein, 40.2 g of sodium chloride was added a time when the number average diameter of the particles was attained at 4-7 μm to stop the growing the particles. Moreover, the fusion of the particles was continued as a ripening treatment by heating and stirring for 6 hours at 98° C.

Furthermore, 96 g of Latex 3L (dispersion of resin particles) was added to the resulted liquid and the system was heated and stirred for 3 hours to fuse latex 3L onto the surface of the associated particle of Latex 2HML. Thereafter, the liquid was added with 40.2 g of sodium chloride and cooled by 30° C. in a rate of 8° C./minute and then the pH was adjusted to 2.0 by the addition of hydrochloric acid, and the stirring was stopped. Thus obtained particles were filtered and repeatedly washed by deionized water at 45° C. and dried by warmed air at 40° C. Thus Colored Particle Bk1.

Preparation of Toner Bk2: High Water Content Magenta Toner

Toner Bk2 was prepared in the same manner as in Toner Bk1 except that amount of methacrylic acid was changed to 30 g during the preparation of Latex 3L (shell), and that the amount of magnesium chloride hexahydrate was changed to 19.5 g during the preparation of associated particle (coagulation fusion process).

Preparation of Toner Bk3: High Water Content Magenta Toner

Toner Bk3 was prepared in the same manner as in Toner Bk1 except that amount of methacrylic acid was changed to 30 g during the preparation of Latex 3L (shell), and that the amount of magnesium chloride hexahydrate was changed to 54.2 g during the preparation of associated particle (coagulation fusion process).

Preparation of Toner Bk4: High Water Content Magenta Toner

Toner Bk4 was prepared in the same manner as in Toner Bk1 except that amount of methacrylic acid was changed to 30 g during the preparation of Latex 3L (shell), and that the amount of magnesium chloride hexahydrate was changed to 66.8 g during the preparation of associated particle (coagulation fusion process).

Preparation of Toner Y2 through Y5: High Water Content Yellow toner

Toners Y2 through Y5 were each prepared in the same manner as Toner Bk1 through Bk4 except that monoazo pigment, C.I. Pigment Yellow 74, was employed in place of carbon black.

Preparation of Toner C2 through C5: High Water Content Cyan Toner

Toners Toner C2 through C5 were each prepared in the same manner as Toner Bk1 through Bk4 except that C.I. Pigment Blue 15:3 was employed in place of carbon black.

Preparation of Toner M2 through M5: High Water Content Magenta Toner

Toners C2 through C5 were each prepared in the same manner as Toner Bk1 through Bk4 except that C.I. Pigment Red 122 was employed in place of carbon black.

Processing of External Additive

To each of Magenta Toners M1 through M4, Cyan Toners C1 through C4, Yellow Toners Y1 through Y4, and Black Toners Bk1 through Bk5, 1.0% by weight of hydrophobic silica having a number average primary particle diameter of 10 nm and a hydrophobic degree of 63 and 1.2% by weight of hydrophobic titanium oxide having a number average primary particle diameter of 25 nm and a hydrophobic degree of 60 were added and mixed by a Henschel mixer.

Physical property of average sphericity, water content, carboxyl content, and metal element content were measured by means of instruments mentioned above. The metal content was measured for sodium, magnesium and aluminum in this Example due to the material, however the metal is not restricted to these in this invention. The result is summarized in Table 1.

The measured result of average sphericity and water content were confirmed that they were not different before and after addition of the external additives.

TABLE 1

| Color | Toner No. | Water Content (weight %) | Average of Sphericity | Carboxyl Content ($10^{-5}$ mol/g) | Metal content (ppm)* |
|---|---|---|---|---|---|
| Magenta | M1 | 0.62 | 0.966 | 0.4 | 1,500 |
| | M2 | 0.92 | 0.967 | 0.8 | 2,500 |
| | M3 | 0.32 | 0.981 | 0.2 | 880 |
| | M4 | 2.77 | 0.966 | 2.8 | 5,800 |
| Cyan | C1 | 0.62 | 0.971 | 0.4 | 1,700 |
| | C2 | 0.93 | 0.967 | 0.7 | 2,400 |

TABLE 1-continued

| Color | Toner No. | Water Content (weight %) | Average of Sphericity | Carboxyl Content ($10^{-5}$ mol/g) | Metal content (ppm)* |
|---|---|---|---|---|---|
| | C3 | 0.32 | 0.981 | 0.2 | 960 |
| | C4 | 2.77 | 0.972 | 2.7 | 5,500 |
| Yellow | Y1 | 0.62 | 0.966 | 0.3 | 1,650 |
| | Y2 | 1.83 | 0.967 | 1.9 | 3,800 |
| | Y3 | 1.22 | 0.968 | 0.7 | 2,800 |
| | Y4 | 1.96 | 0.981 | 1.8 | 4,800 |
| | Y1 | 2.77 | 0.975 | 2.8 | 76,300 |
| Black | Bk1 | 1.83 | 0.966 | 2.0 | 4,000 |
| | Bk2 | 1.22 | 0.981 | 1.0 | 3,100 |
| | Bk3 | 1.96 | 0.966 | 2.3 | 4,700 |
| | Bk4 | 2.77 | 0.968 | 2.8 | 5,300 |
| | Bk5 | 0.82 | 0.970 | 0.4 | 2,000 |

Metal content was measured with reference to Na, Mg and Al in this Example.

Preparation of Ferrite Carrier

Resin coated ferrite carrier was obtained by employing coating resin on the ferrite core mentioned below.

In a wet type ball mill, 18 mole-% of MnO, 4 mole-% of MgO and 78 mole-% of Fe2O3 were crushed and mixed for 2 hours and dried. After that, the dried mixture was provisionally baked at 900° C. for 2 hours, and crushed by a ball mill for 3 hours and made to slurry. The slurry was granulated and dried by a spray dryer after the addition of a dispersing agent and a binder, and then the dried granules were subjected to main baking at 1,200° C. for 3 hours. The ferrite particles having 3×10 Ωcm was obtained.

Preparation of Coating Resin

First, by an emulsion polymerization method in which concentration in the aqueous solution media using the sodium benzenesulfonate having an alkyl group of carbon atoms 12 as a surfactant was made into 0.3 weight %, a copolymer of cyclo hexyl methacrylate/methyl methacrylate (copolymerization ratios 5/5) was synthesized, resin fine particles having a volume average diameter of the primary particles of 0.1 μm, a weight average molecular weight (Mw) of 200,000, a number average molecular weight (Mn) of 91,000, an Mw/Mn ratio of 2.2, a softening point (Tsp) of 230° C. and a glass transition point (Tg) of 110° C. were obtained. Incidentally, in the emulsification state, the above-mentioned resin fine particles were on azeotropy with water and the amount of residual monomers was 510 ppm.

Into a high speed stirring mixer having stirring wings, 100 parts by weight of the ferrite core particle, and 2 parts by weight of the above-described resin fine particle, 0.2 parts of fluoro acrylate resin (1-1-1-trifluoro-ethylmethacrylate copolymer), and 0.4 parts of carbon black were put and stirred for 30 minutes at 120° C. so as to be obtain resin coated carrier having a volume average particle diameter of 39 μm by utilizing the mechanical impact.

Preparation of Developer

Each of Toner Particles was mixed with the above carrier to prepare developers of each color having a toner concentration of 6% by weight.

The developers of each color were denoted as a set of toners. For example, a developer set comprising a black toner Bk1, a yellow toner Y1, a magenta toner M1 and a cyan toner C1 in combination is denoted as Developer 1, and the other combinations of toners are denoted as Developers 2-11, as shown in Table 2.

The obtained developer sets 1-11 are shown in Table 2.

TABLE 2

| Developer | Toner combination* | | | |
|---|---|---|---|---|
| 1 | Y1 (0.62) | M1 (0.62) | C1 (0.62) | Bk1 (1.83) |
| 2 | Y1 (0.62) | M2 (0.92) | C2 (0.93) | Bk2 (1.22) |
| 3 | Y1 (0.62) | M3 (0.32) | C3 (0.32) | Bk3 (1.96) |
| 4 | Y1 (0.62) | M1 (0.62) | C1 (0.62) | Bk4 (2.77) |
| 5 | Y2 (1.83) | M1 (0.62) | C1 (0.62) | Bk5 (0.82) |
| 6 | Y3 (1.22) | M1 (0.62) | C1 (0.62) | Bk5 (0.82) |
| 7 | Y4 (1.96) | M1 (0.62) | C1 (0.62) | Bk5 (0.82) |
| 8 | Y5 (2.77) | M1 (0.62) | C1 (0.62) | Bk5 (0.82) |
| 9 | Y6 (2.77) | M1 (0.62) | C1 (0.62) | Bk4 (2.77) |
| 10 | Y1 (0.62) | M1 (0.62) | C1 (0.62) | Bk5 (0.82) |
| 11 | Y5 (2.77) | M4 (2.77) | C4 (2.77) | Bk4 (2.77) |

*Numeral in parenthesis is water content in %.

A full color image was formed by employing the each of obtained developer sets in a non-tandem image forming apparatus as shown in FIG. 2. Toner blister after fixing of toner image and toner scattering during the image formation were evaluated as follows.

Evaluation of Formation of Toner Blisters

Images were formed on plain paper (at 64 g/cm$^2$ of paper) to result in a toner adhesion amount of 1.6 mg/cm$^2$, and the presence in the images of pores at a size of 0.1-0.5 μm, namely toner blisters, was visually observed and evaluated based on the criteria below.

A: No generation of toner blisters was observed.

B: One or two toner blisters per 4 cm$^2$ were observed but were at a level of no problem for commercial viability.

C: Two toner blisters per 4 cm$^2$ were observed but were at a level of no problem for commercial viability.

D: At least 3 toner blisters per 4 cm$^2$ were clearly noted, and were ranked to be at a level of no commercial viability.

Evaluation of Leakage of Scattered Toner

Leakage of toner from an opening closed to developer sleeve 141 of the developing device 14 was observed. After image formation until the time-life of the toner (about 250, 000 sheets printing), leaked toner was observed. About 500, 000 sheets printing was conducted if necessary.

A: Neither toner scattered toner or toner leakage was observed.

B: Slight scattered toner was observed, but no toner leakage outside of the developing device was observed.

C: Scattered toner around the developer sleeve was observed, but no toner leakage outside of the developing device was observed.

D: Toner leakage outside of the developing device was observed.

The result is shown in Table 3

TABLE 3

| Developer | Blister | Toner Leakage |
|---|---|---|
| 1 | A | A |
| 2 | B | A |
| 3 | A | A |
| 4 | B | A |
| 5 | B | B |
| 6 | B | B |
| 7 | B | B |
| 8 | B | B |
| 9 | B | B |
| 10 | C | D |
| 11 | D | C |

The developer sets 1-11 were evaluated by an image forming apparatus shown in FIG. 2.

The result shows that the samples Nos. 1-9 according to this invention toner blister of full color image after fixing is prevented effectively and generation of toner blister during the image forming is minimized in comparison the comparative samples Nos. 10 and 11.

Example 2

The Example 1 was conducted except that the image forming apparatus was changed to one shown in FIG. 3, to evaluate the toner blister and toner scattering as Example 1. The similar result shown in Table 3 was obtained, and the samples according to this invention toner blister of full color image after fixing is prevented effectively and generation of toner blister during the image forming is minimized.

The invention claimed is:

1. An electrophotographic image forming method comprising:

forming a color image composed of yellow, magenta, cyan and black toners on an image forming material, wherein the black toner has water content of from 1.3 to 2.0% by weight based on the black content toner, and water content of each of the other toners is 0.3 to 1.0% by weight based on each of the other toners.

2. The method of claim 1, wherein an average of circularity of toner particles of each of the yellow, magenta, cyan and black toners is 0.94 to 0.99.

3. The method of claim 1, wherein each of the yellow, magenta, cyan and black toners does not contain a magnetic material.

4. The method of claim 1, wherein a ratio of toner particles without corners is at least 50 percent by number based on the toner particles in each of the yellow, magenta, cyan and black toners.

5. The method of claim 1, wherein each of the yellow, magenta, cyan and black toner particles exhibits a circularity degree of 0.963 to 0.981.

6. The method of claim 1, wherein forming a color image composed of yellow, magenta, cyan and black toners on an image forming material comprises:

forming a color image comprising the yellow, magenta, cyan and black toners on a latent image bearing body, transferring the color image on the latent image bearing body to the image forming material; and fixing the color images on the image forming material.

7. The method of claim 1, wherein forming a color image composed of yellow, magenta, cyan and black toners on an image forming material comprises:

forming a latent image corresponding to a yellow image on a latent image bearing body, developing the latent image corresponding to a yellow image employing a developer comprising the yellow toner to form a yellow toner image on the latent image bearing body, forming a latent image corresponding to a magenta image on the latent image bearing body, developing the latent image corresponding to a magenta image employing a developer comprising the magenta toner to form a magenta toner image on the latent image bearing body, forming a latent image corresponding to a cyan image on the latent image bearing body, developing the latent image corresponding to a cyan image employing a developer comprising the cyan toner to form a cyan toner image on the latent image bearing body, forming a latent image corresponding to a black image on the latent image bearing body, developing the latent image corresponding to a black image employing a developer comprising the black toner to form a black toner image on the latent image bearing body, transferring the yellow, magenta, cyan and black toner images on the latent image bearing body to the image forming material; and fixing the yellow, magenta, cyan and black toner images on the image forming material.

8. The method of claim 1, wherein forming a color image composed of yellow, magenta, cyan and black toners on an image forming material comprises:

forming a first toner image of one of the yellow, magenta, cyan and black toners on a latent image bearing body and transferring the first toner image on an intermediate image support, forming a second toner image of one of the yellow, magenta, cyan and black toners on a latent image bearing body and transferring the second toner image on the intermediate image support having the first toner image, forming a third toner image of one of the yellow, magenta, cyan and black toners on a latent image bearing body and transferring the third toner image on the intermediate image support having the first and second toner images, forming a fourth toner image of one of the yellow, magenta, cyan and black toners on the latent image bearing body and transferring the fourth toner image on the intermediate image support having the first, second and third toner images to form a color image, transferring the color image on the intermediate image support to an image forming support; and fixing the color image on the image forming support.

9. The method of claim 1, wherein forming a color image composed of yellow, magenta, cyan and black toners on an image forming material comprises:

forming a latent image corresponding to a yellow image on a latent image bearing body, developing the latent image corresponding to a yellow image employing a developer comprising the yellow toner to form a yellow toner image on the latent image bearing body, transferring the yellow toner image on the latent image bearing body to an intermediate transfer body;

forming a latent image corresponding to a magenta image on the latent image bearing body, developing the latent image corresponding to a magenta image employing a developer comprising the magenta toner to form a magenta toner image on the latent image bearing body, transferring the magenta toner image on the latent image bearing body to the intermediate transfer body;

forming a latent image corresponding to a cyan image on the latent image bearing body, developing the latent image corresponding to a cyan image employing a developer comprising the cyan toner to form a cyan toner image on the latent image bearing body, transferring the cyan toner image on the latent image bearing body to the intermediate transfer body;

forming a latent image corresponding to a black image on the latent image bearing body, developing the latent image corresponding to a black image employing a developer comprising the black toner to form a black toner image on the latent image bearing body, transferring the toner image on the latent image bearing body to the intermediate transfer body;

transferring the yellow, magenta, cyan and black toner images on the intermediate transfer body to the image forming material; and fixing the toner images formed on the image forming material.

10. The method of claim 1, wherein an amount of carboxy group on a surface of the black toner is more than $0.5\times10^{-5}$ to $2.8\times10^{-5}$ mol/g, and an amount of carboxy group on a surface of the yellow, magenta and cyan toner is not more than $0.5\times10^{-5}$ mol/g.

11. The method of claim 1, wherein an amount of carboxy group on a surface of the black toner is $0.7\times10^{-5}$ to $2.3\times10^{-5}$ mol/g, and an amount of carboxy group on a surface of the yellow, magenta and cyan toner is $0.1\times10^{-5}$ to $0.4\times10^{-5}$ mol/g.

12. The method of claim 1, wherein an amount of metal element in the black toner is 0.5 to 3 weight %, and an amount of metal element in the yellow, magenta and cyan toner is 0 to 0.5 weight %.

13. The method of claim 1, wherein an amount of metal element in the black toner is 0.7 to 1.25 weight %, and an amount of metal element in the yellow, magenta and cyan toner is 0.08 to 0.3 weight %.

14. The method of claim 1, wherein an amount of carboxy group on a surface of the black toner is more than $0.5\times10^{-5}$ to $2.8\times10^{-5}$ mol/g, and an amount of carboxy group on a surface of the yellow, magenta and cyan toner is not more than $0.5\times10^{-5}$ mol/g, and an amount of metal element in the black toner is 0.5 to 3 weight %, and an amount of metal element in the yellow, magenta and cyan toner is 0 to 0.5 weight %.

15. The method of claim 1, wherein each of the black, yellow, magenta and cyan toner comprises a releasing agent including an ester compound represented by Formula $$R^1\text{—}(OCO\text{—}R^2)_n$$

wherein n represents an integer of 1 to 4, and R' and $R^2$ each represent a hydrocarbon group which may have a substituent respectively.

16. The method of claim 1, wherein forming a color image composed of yellow, magenta, cyan and black toners on an image forming material comprises forming the color image by superposing yellow, magenta, cyan and black toner images, wherein the black toner image is superposed after the yellow, magenta and cyan toner images are superposed on each other.

* * * * *